US009290989B2

(12) United States Patent
Lynch et al.

(10) Patent No.: US 9,290,989 B2
(45) **Date of Patent: *Mar. 22, 2016**

(54) DOOR WITH GLASS INSERT AND METHOD FOR ASSEMBLING THE SAME

(71) Applicant: Masonite Corporation, Tampa, FL (US)

(72) Inventors: Steven Lynch, North Aurora, IL (US); Jason Caulk, Tampa, FL (US); Jason M. Walsh, Batavia, IL (US); Mark A. Ruggie, Kingston, IL (US); Timothy D. Gouge, Elgin, IL (US); Gary Thomas Fagan, Huntersville, NC (US); Eric Duane Bennett, Huntersville, NC (US); Haritha Wunnava, Charlotte, NC (US); Danny Lee Fitts, Bonaqua, TN (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/445,707

(22) Filed: Jul. 29, 2014

(65) Prior Publication Data

US 2015/0024164 A1 Jan. 22, 2015

Related U.S. Application Data

(63) Continuation of application No. 13/210,968, filed on Aug. 16, 2011, now Pat. No. 8,789,330, which is a continuation of application No. 12/786,872, filed on May 25, 2010, now Pat. No. 7,997,040, which is a (Continued)

(51) Int. Cl.
*E06B 3/58* (2006.01)
*E06B 7/28* (2006.01)

(Continued)

(52) U.S. Cl.
CPC ... *E06B 7/28* (2013.01); *E06B 1/34* (2013.01); *E06B 3/5892* (2013.01);

(Continued)

(58) Field of Classification Search
CPC ..... E06B 3/5892; E06B 3/7001; E06B 2003/7023; E06B 3/58; E06B 7/28; E06B 1/34; E06B 3/78
USPC ..... 52/455, 456, 784.1, 784.13, 792.1, 52/792.11, 208, 794.1, 309.9, 784.15, 52/204.54, 212, 204.53, 717.01; 49/501, 49/475.1, 484.1, 495.1, 504
See application file for complete search history.

(56) References Cited

U.S. PATENT DOCUMENTS 1,171,443 A 2/1916 Larson et al.
3,411,247 A 11/1968 Fleming (Continued)

FOREIGN PATENT DOCUMENTS

EP 601693 A1 6/1994
EP 1094192 A1 4/2001
GB 2377470 A 1/2003

*Primary Examiner* — Adriana Figueroa
*Assistant Examiner* — Jessie Fonseca
(74) *Attorney, Agent, or Firm* — Berenato & White, LLC

(57) ABSTRACT

A door comprising first and second door skins secured to each other to form a cavity therebetween filled with expended foam. Each of the door skins has an opening therethrough for receiving a glass insert and a flange portion. Distal ends of the flange portions of the first and second door skins engage each other in an overlapping relationship by the expansion pressure of the expanded foam. The door further comprises a glazing rim member having a leg portion snap-locked between the flange portions of the first and second door skins. The method for assembling the door comprises the steps of filling the cavity between the door skins with foam material, then inserting the glass insert through the openings in the door skins and mounting the glazing rim member to the first door skin by snap-locking between the flange portions of the first and second door skins.

20 Claims, 7 Drawing Sheets

Related U.S. Application Data continuation of application No. 11/714,281, filed on Mar. 6, 2007, now Pat. No. 7,721,501.

(60) Provisional application No. 60/778,974, filed on Mar. 6, 2006.

(51) Int. Cl.

| | |
|---|---|
| ***E06B 3/78*** | (2006.01) |
| ***E06B 1/34*** | (2006.01) |
| ***E06B 5/00*** | (2006.01) |
| *E06B 3/70* | (2006.01) |

(52) U.S. Cl.

CPC ..... *E06B 3/7001* (2013.01); *E06B 3/78* (2013.01); *E06B 5/00* (2013.01); *E06B 5/003* (2013.01); *E06B 2003/7023* (2013.01); *Y10T 16/78* (2015.01); *Y10T 428/24281* (2015.01)

(56) References Cited

U.S. PATENT DOCUMENTS

| | | | | |
|---|---|---|---|---|
| 3,641,721 | A | 2/1972 | Martin | |
| 3,750,358 | A | 8/1973 | Lewkowitz | |
| 3,903,669 | A | 9/1975 | Pease, Jr. et al. | |
| 4,327,535 | A | 5/1982 | Governale | |
| 4,720,951 | A | 1/1988 | Thorn et al. | |
| 4,850,168 | A | 7/1989 | Thorn | |
| 4,897,975 | A | 2/1990 | Artwick et al. | |
| 4,920,718 | A | 5/1990 | Artwick et al. | |
| 4,947,597 | A | 8/1990 | Simpson | |
| 4,977,722 | A | 12/1990 | Taylor | |
| 5,018,330 | A | 5/1991 | Lewkowitz | |
| 5,105,597 | A | 4/1992 | Wilkening | |
| 5,325,648 | A | 7/1994 | Menard | |
| 5,544,454 | A | 8/1996 | Richardson et al. | |
| 5,557,899 | A | 9/1996 | Dube et al. | |
| 5,577,355 | A | 11/1996 | Leonelli | |
| 5,603,585 | A | 2/1997 | Bruchu et al. | |
| 5,765,325 | A | 6/1998 | DeBlock | |
| 5,837,095 | A | 11/1998 | Bruchu et al. | |
| 5,887,398 | A | 3/1999 | Chen | |
| 6,151,849 | A | 11/2000 | Twigg et al. | |
| 6,161,363 | A | 12/2000 | Herbst | |
| 6,311,454 | B1 | 11/2001 | Kempel | |
| 6,318,037 | B1 | 11/2001 | Hansen | |
| 6,434,898 | B1 | 8/2002 | Ward et al. | |
| 6,546,682 | B1 | 4/2003 | DeBlock et al. | |
| 6,553,735 | B1 | 4/2003 | Wang Chen | |
| 6,574,935 | B2 | 6/2003 | Wang Chen | |
| 6,619,005 | B1 | 9/2003 | Chen | |
| 6,688,064 | B1 | 2/2004 | Swanick | |
| 6,694,701 | B2 | 2/2004 | Wang et al. | |
| 6,729,095 | B2 | 5/2004 | Chen | |
| 6,931,810 | B2 | 8/2005 | Beaudoin et al. | |
| 7,721,501 | B2 | 5/2010 | Lynch et al. | |
| 7,997,040 | B2 | 8/2011 | Lynch et al. | |
| 8,789,330 | B2 | 7/2014 | Lynch et al. | |
| 2002/0092254 | A1 | 7/2002 | Wang Chen | |
| 2003/0019178 | A1 | 1/2003 | Wang Chen | |
| 2003/0205015 | A1 | 11/2003 | Birmingham et al. | |
| 2004/0144046 | A1 | 7/2004 | Wang et al. | |
| 2005/0266222 | A1* | 12/2005 | Clark et al. | 428/292.1 |
| 2007/0193140 | A1 | 8/2007 | Carnick et al. | |

* cited by examiner

DOOR WITH GLASS INSERT AND METHOD FOR ASSEMBLING THE SAME

CROSS-REFERENCE TO RELATED APPLICATIONS AND CLAIM TO PRIORITY

This application is a continuation of Ser. No. 13/210,968, filed Aug. 16, 2011, now U.S. Pat. No. 8,789,330, which is a continuation of application Ser. No. 12/786,872, filed May 25, 2010, now U.S. Pat. No. 7,997,040, which is a continuation of application Ser. No. 11/714,281, filed Mar. 6, 2007, now U.S. Pat. No. 7,721,501, which claims priority to provisional application Ser. No. 60/778,974, filed on Mar. 6, 2006, the disclosures of which are incorporated herein by reference and to which priority is claimed.

FIELD OF THE INVENTION

The present invention relates generally to door assemblies in general, and, more particularly, to a door having a glass insert and a method for assembling the same.

BACKGROUND OF THE INVENTION

A commonplace substitution for the traditional wooden doors in residential and commercial buildings is a door made from steel or fiberglass. One type of synthetic door is formed with resin sheets reinforced with fiber glass (in the art referred to as door skins) attached to opposite sides of rails and stiles forming a rectangular frame, with the resulting cavity between the door skins filled with a polymer foam material. Doors so constructed can include wood graining on the outer surfaces of the skins, and also raised paneling formed (molded) in the skins, which gives these doors the appearance of natural wood fabricated products.

Molded skins for making such doors are typically formed using mixtures having by weight 12% to 15% polyester resin, 5% to 15% polystyrene, 40% to 50% calcium carbonate and 15% to 25% chopped fiberglass. Such mixtures are deposited in a compression molding machine and subjected to pressures from 600 to 1,500 psi and elevated temperatures for a cure cycle of from 60 to 200 seconds to form rigid skins. The mixture described is one of those known as a "sheet molding compound" (SMC).

The door skins formed from SMC processes for doors can have thicknesses of from about 0.13 mm (0.05 inches) to about 52 mm (0.20 inches), depending on the door application in which they are used.

As previously noted such skins are affixed to opposite sides of a rectangular frame and the core (cavity) enclosed by the frame and skins is filled with polymer foam to complete the door. A rigid urethane foam having a density of 0.8 pounds per cubic foot to 3.5 pounds per cubic foot is suitable for the core of such doors.

Previously, these doors may have had glass inserts (glazing or lights) that covered less than 30% of the door's exterior surface. Currently the marketplace demands doors with larger glass inserts, which can comprise more than 60% of the door's exterior surface. Due to building codes, these large glass inserts must be double glazed (double pane) and in some cases made of safety glass. While known doors with glass inserts have proven to be acceptable for various applications, such doors are nevertheless susceptible to improvements that may enhance their performance and lower cost. With this in mind, a need exists to develop improved doors with glass inserts that advance the art.

SUMMARY OF THE INVENTION

The present invention provides an improved door having a large central glass insert and a method for assembling the same. Alternatively, the invention is an improved building component having a lite, such as a door, a side lite, or a transom lite.

According to a first aspect of the present invention, there is provided an improved door having a large central glass insert. The door includes a first door skin having a first planar portion formed with a first opening for receiving a glass insert, the first opening being defined by a first flange extending inward from the first planar portion and a lip portion extending from where the first flange meets the first planar portion and substantially parallel to the first planar portion to contact a first major surface of the glass insert. The door further includes a second door skin opposite to the first door skin to form a cavity therebetween and having a second planar portion formed with a second opening for receiving the glass insert, the second opening defined by a second flange extending into the cavity from the second planar portion to engage the first flange. The door further includes a glazing rim member having a leg portion disposed on a surface of the second flange with and a lip portion extending substantially parallel to the second planar portion of the second door skin and having at least one flexible sealant fin extending from the lip portion to apply a contact pressure to a second major surface of the glass insert, and a core material disposed in the cavity between the first and second door skins.

According to a second aspect of the present invention, there is provided a door having an improved structure. The door includes first and second door skins operatively secured to form a cavity therebetween filled with a foam material. Each of the first and second door skins has a substantially planar plate portion formed with an opening therethrough for receiving a glass insert, each opening defined by a flange portion formed integrally with the planar plate portion and extending substantially inwardly therefrom toward the opposite door skin. The second door skin has a lip portion formed integrally with the planar plate portion of the second door skin and extending from the flange portion substantially along the planar plate portion. The flange portion of the first door skin has a thickness allowing substantially no deflection thereof due to the expansion pressure of the expanding foam material within the cavity. The flange portion of the second door skin has a thickness allowing some deflection thereof due to the expansion pressure of the expanding foam material within the cavity. Distal ends of the flange portions of the first and second door skins engaging each other in an overlapping relationship to form an interlocking lap joint and define the cavity between the first and second door skins. The door further includes a glazing rim member including a lip portion disposed opposite the lip portion of the second door skin and a leg portion supported by the flange portion of the first door skin.

According to a third aspect of the present invention, a building component having an improved structure is provided. The building component includes a first building component skin having a first planar portion formed with a first opening for receiving a glass insert, the first opening being defined by a first flange extending inward from the first planar portion and a lip portion extending from where the first flange meets the first planar portion and substantially parallel to the first planar portion to contact a first major surface of the glass insert. The building component further includes a second building component skin opposite to the first building component skin to form a cavity therebetween and having a second planar portion formed with a second opening for receiving the glass insert, the second opening defined by a second flange extending into the cavity from the second planar portion to engage the first flange. The building component further includes a glazing rim member having a leg portion disposed on a surface of the second flange with and a lip portion extending substantially parallel to the second planar portion of the second building component skin and having at least one flexible sealant fin extending from the lip portion to apply a contact pressure to a second major surface of the glass insert. The building component further includes a core material disposed in the cavity between the first and second building component skins.

According to a fourth aspect of the invention, a method is provided. The method includes providing a first door skin having a substantially planar plate portion integrally formed with a flange portion extending substantially normally therefrom so as to define an opening through the first door skin, providing a second door skin having a substantially planar plate portion integrally formed with a flange portion extending substantially normally therefrom so as to define an opening through the second door skin and a lip portion formed integrally with the planar plate portion of the second door skin and extending from the flange portion substantially along the planar plate portion, holding the first and second door skins together by engaging distal ends of the flange portions of the first and second door skins in an overlapping relationship to form a lap joint and to define a cavity between the first and second door skins, inserting a core material into the cavity, inserting a glass insert through the opening in the second door skin so that the glass insert engages the lip portion of the first door skin, providing a glazing rim member including a lip portion and a leg portion, mounting the glazing rim member to the second door skin so that the lip portion of the glazing rim member is disposed opposite the lip portion of the first door skin and a distal end of the leg portion is snap-locked between the flange portion of the second door skin and the distal end of the flange portion of the first door skin.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENT(S)

The preferred embodiment of the present invention will now be described with the reference to accompanying drawings.

Figure 1:
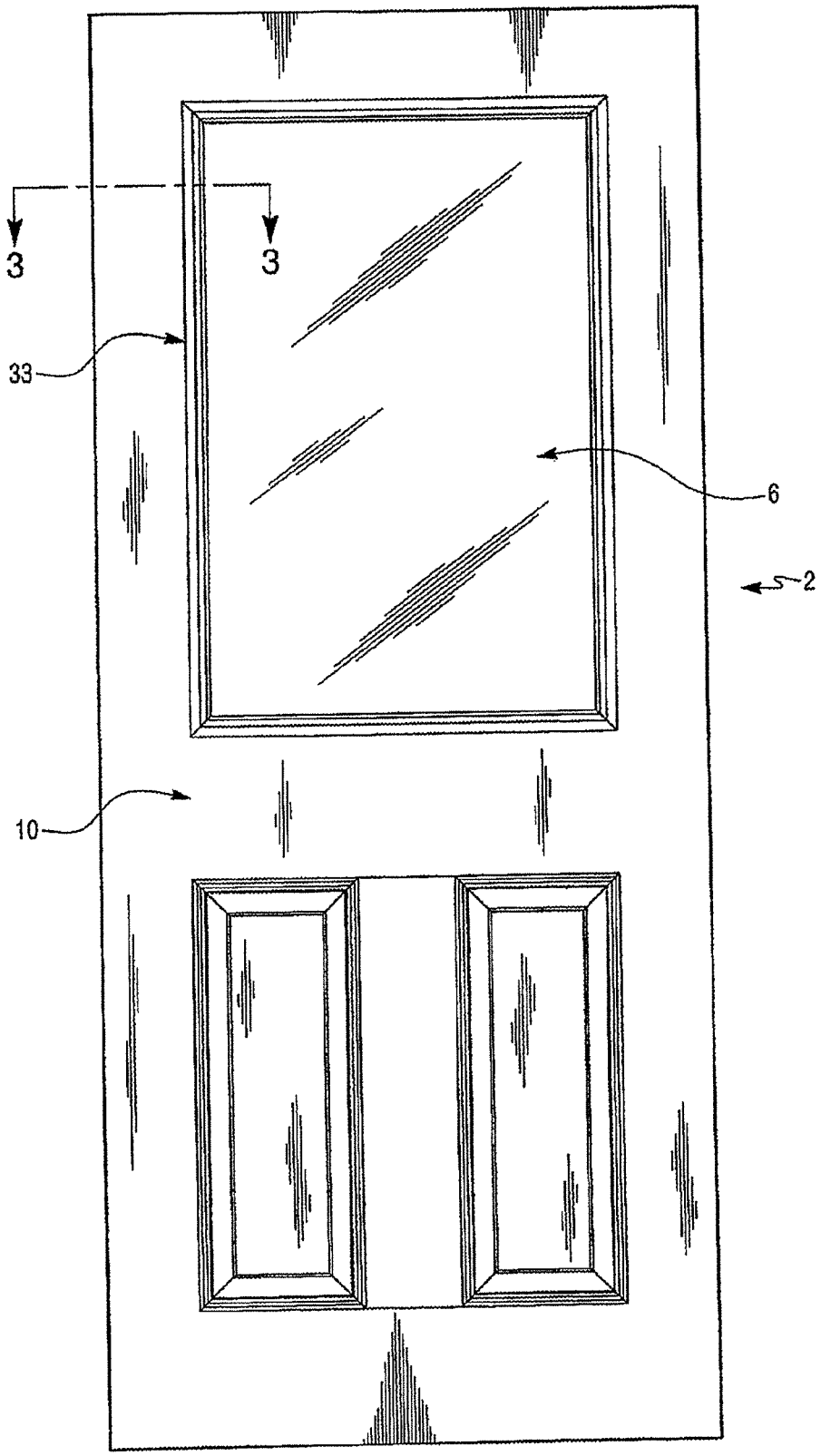
FIG. 1 is a plan view of a door of the present invention.
Figure 2A:
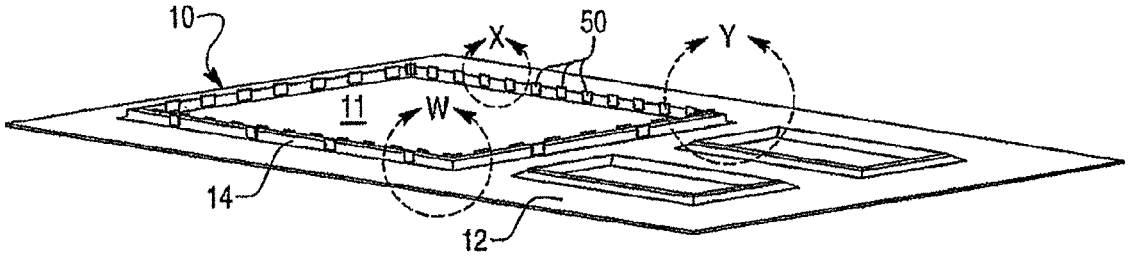
FIG. 2A is a perspective view of an inner surface of a first door skin according to the preferred embodiment of the present invention.
Figure 3:
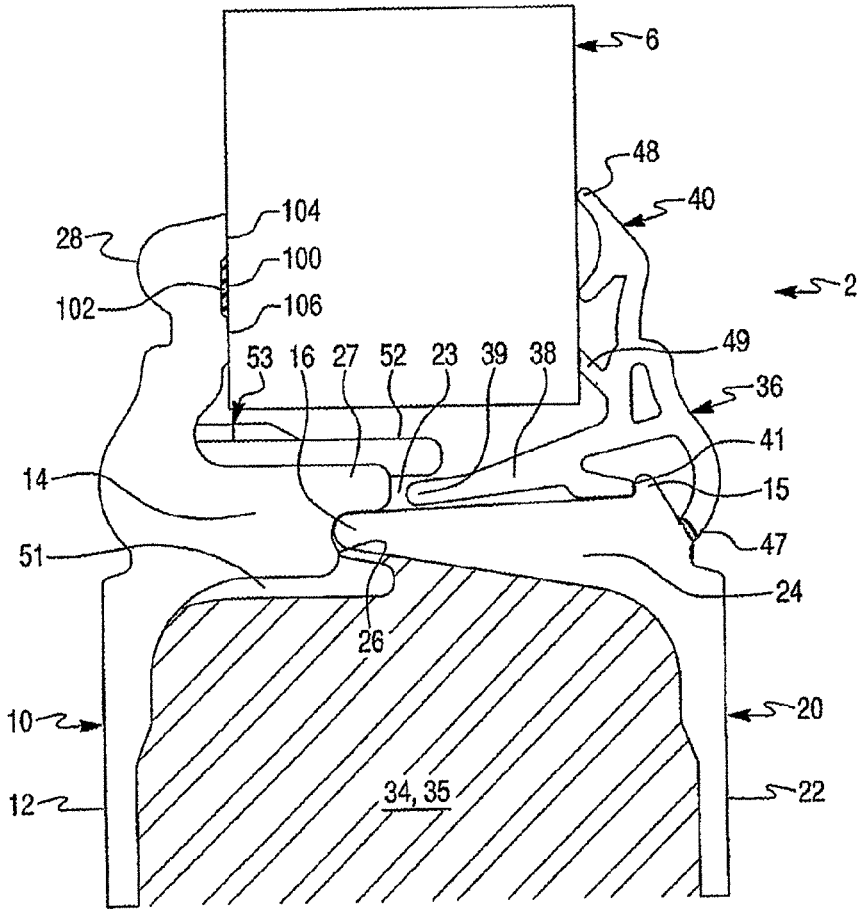
FIG. 3 is a fragmentary cross-sectional view of the door in FIG. 1 according to the preferred embodiment of the present invention.
Figure 2B:
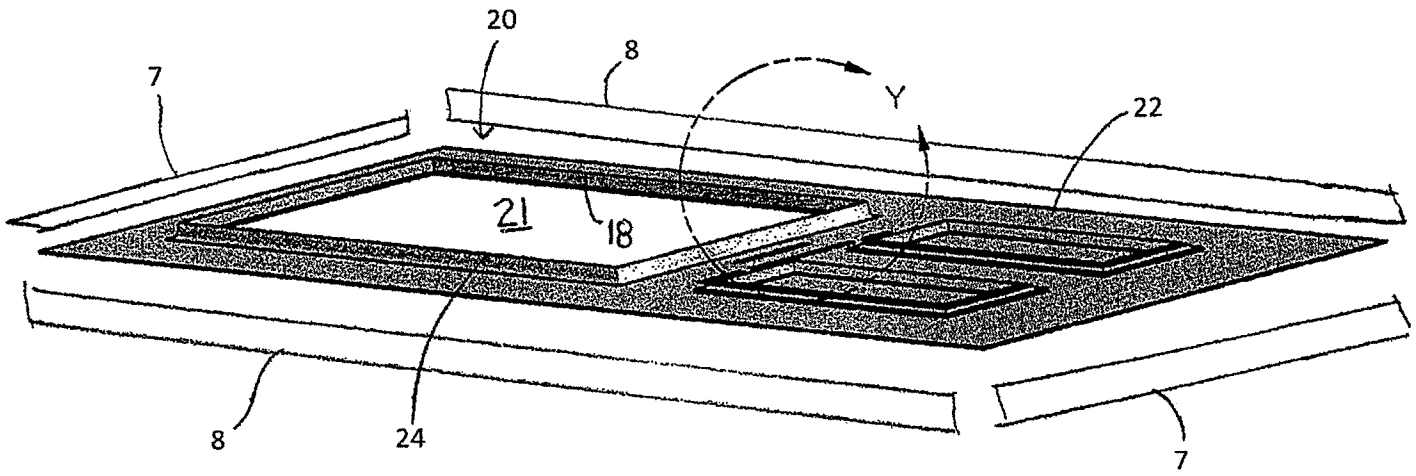
FIG. 2B is an exploded perspective view of an inner surface of a second door skin according to the preferred embodiment of the present invention.

FIG. 1 illustrates a door of the present invention indicated generally by reference numeral 2. The door 2 being formed from fiberglass reinforced SMC door skins 10 and 20, as best shown in FIGS. 2A and 2B. The door 2 is provided with a preferably rectangular opening for receiving a glass insert (or panel) 6. As best shown in FIGS. 2A, 2B, and 3, the door 2 comprises first and second door skins 10 and 20, respectively, top and bottom rails 7, and left and right stiles 8. The first door skin 10 and the second door skin 20 may correspond to an exterior door skin and an interior door skin, respectively. The first and second door skins 10 and 20 are secured to each other through the top and bottom rails 7 and the left and right stiles 8, typically secured with adhesive, such as moisture cured urethane adhesive, to the door skins 10, 20, and forming a rectangular door frame. Referring now to FIG. 3, the first and second door skins 10 and 20 are so secured to the frame to form a cavity 34 therebetween. The cavity 34 of the door 2 is filled with an expanded foam insulating material 35 defining an insulating core 35 of the door 2.

Preferably, the first and second door skins 10 and 20 are molded from an appropriate polymer material and have a thickness of about 1 to 4 mm. The material of the door skins 10 and 20 of the present invention can be sheet molding compound (SMC) reinforced with fiber glass, wood fiber, steel or wood. Preferably, the door skins 10 and 20 are molded and can be made from such materials as fiberglass reinforced plastics, pressed board, vinyl esters, polystyrenes or other moldable materials. An outer surface of the door skins 10 or 20 can be smooth without wood grain or can have a simulated wood grain. The depth of the wood grain is about 0.05 to 0.2 mm. An inner surface of the door skins may have a relatively rough surface to increase the surface area for the adhesive when the door is assembled. This results in stronger bonds between the door skins, the foam material, the rails and the stiles.

As best shown in FIGS. 2A and 2B, each of the first and second door skins 10 and 20 is provided with an opening therethrough for receiving the glass insert 6. More specifically, the first door skin 10 has an opening 11 therethrough, while the second door skin 10 has an opening 21 therethrough. While we prefer that the openings 11, 21 be rectangular, they can have any configuration, provided that they are complementary. As shown in FIGS. 2A and 2B, the first and second door skins 10 and 20 include respective integral flange portions 14 and 24 that extend inward into the cavity 34 (see FIG. 3) and define the respective openings 11 and 21.

As best shown in FIGS. 2A and 3, the first door skin 10 includes a plurality of tabs 50 for positioning the flange portion 24 of the second door skin 20, the glass insert 6, and a glazing rim member 36.

Figure 4:
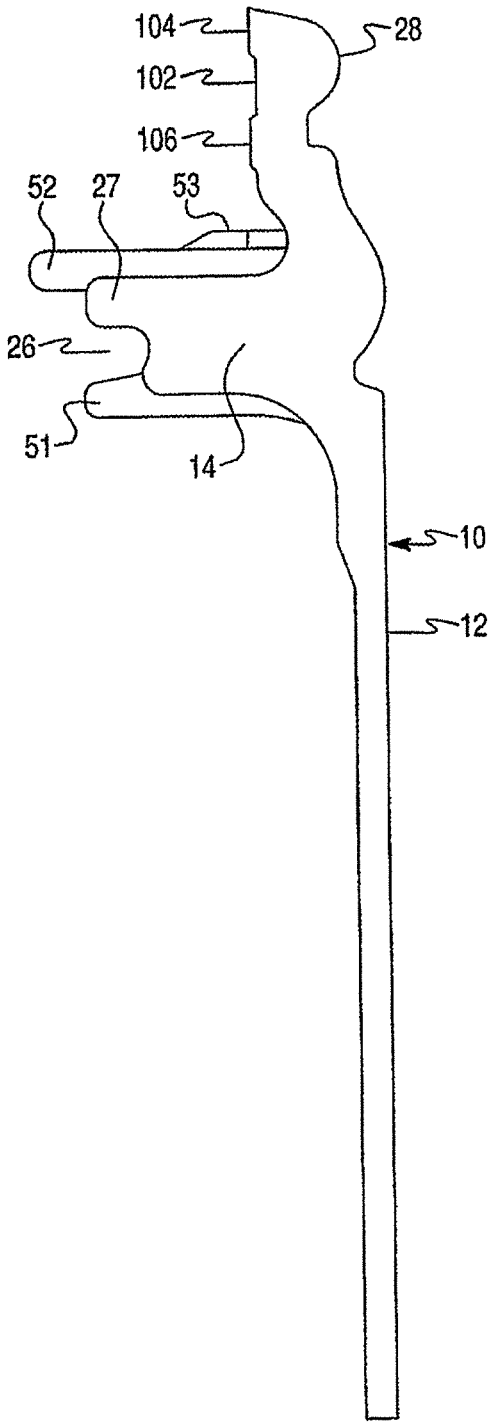
FIG. 4 is a fragmentary cross-sectional view of the first door skin of FIG. 2A according to the preferred embodiment of the present invention.

The first door skin 10, as illustrated in FIG. 4, includes a substantially planar plate portion 12 formed with the opening 11 (see FIG. 2A) therethrough for mounting the glass insert 6, and the flange portion 14 formed integrally with the planar plate portion 12 and extending substantially inwardly therefrom toward the second door skin 20, as shown in FIG. 3.

Preferably, the flange portion 14 extends substantially normal to the planar plate portion 12 of the first door skin 10. The first door skin 10 further includes a lip portion 28 extending upwardly from the flange portion 14 and inwardly at its distal end to support the glass insert 6 positioned within the opening 11 of the first door skin 10. According to the preferred embodiment of the present invention, the first door skin 10 is molded from an appropriate polymer material as a single-piece part.

Furthermore, the flange portion 14 of the first door skin 10 includes a distal end 27 with a first notch 26. The first notch 26 has a geometry configured to mate with a distal end 16 of the flange portion 24 of the second door skin 20 (as shown in FIG. 3).

As mentioned above, the first door skin 10 includes the plurality of positioning tabs 50 shown in FIG. 2A. As shown in FIGS. 3 and 4, the tabs 50 are spread along flange portion 14 and include a plurality of skin positioning tabs 51 extending below the flange portion 14, a plurality of glazing rim locking tabs 52 extending above the flange portion 14, and a plurality of glass insert positioning tabs 53 extending above the glazing rim locking tabs 52.

Figure 5:
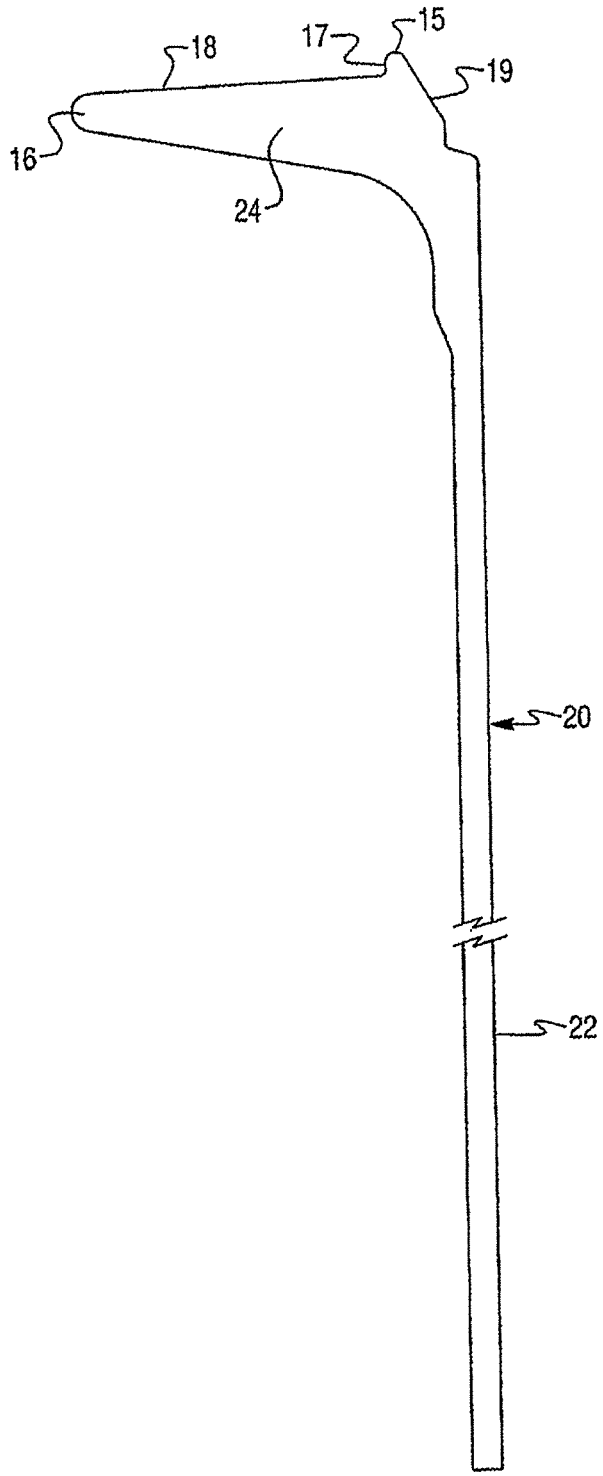
FIG. 5 is a fragmentary cross-sectional view of the second door skin of FIG. 2B according to the preferred embodiment of the present invention.

The second door skin 20, as illustrated in FIG. 5, includes a substantially planar plate portion 22 formed with the opening 21 (see FIG. 2B) therethrough for mounting the glass insert 6, the flange portion 24 formed integrally with the planar plate portion 22 and extending substantially inwardly therefrom toward the first door skin 10, as shown in FIG. 3. An outer peripheral preferably flat surface 18 of the flange portion 24 of the second door skin 20 defines the opening 21 (see FIG. 2B) therethrough, as best shown in FIG. 5. Preferably, the flange portion 24 extends substantially normal to the planar plate portion 22 of the second door skin 20.

Furthermore, as best shown in FIG. 5, the first door skin 20 has a guide rim 15 extending upwardly from the outer peripheral surface 18 of the flange portion 24. The guide rim 15 has a flat inner wall 17 spaced inwardly from and extending substantially parallel to the planar plate portion 22 and an outer wall 19 outwardly inclined relative to the plate portion 22 at an approximately 45° angle. It will be appreciated that any other appropriate angle of inclination of the outer wall 19 relative to the plate portion 22 is within the scope of the present invention. According to the preferred embodiment of the present invention, the second door skin 20 is molded from an appropriate polymer material as a single-piece part.

As best shown in FIG. 3, when the first and second door skins 10 and 20 are assembled together, the distal end 16 of the second flange portion 24 is positioned in the first notch 26 of the first flange portion 14 to form an interlocking joint. The first notch 26 extends the length of the first flange portion 14 and provides stability to the joint. The second flange portion 24 may have a length exceeding the length of the flange portion 14. Preferably, flange portion 24 extends approximately two thirds of the thickness of the cavity 34.

Although a small spacing is shown in FIG. 3 between the second skin positioning tab 51 and the distal end 16 of the second flange portion 24, these components may be shaped such that the distal end 16 of the flange portion 24 fits securely in the first notch 26 substantially without spacing. The first notch of the flange portion 24 cooperates to form a dam that prevents the expendable foam 35 from expanding into the area where the panel 6 is to be received.

Referring back to FIG. 1, the door 2 further comprises a rectangular glazing rim 33 provided for holding and locking the glass insert 6 in the opening of the door 2. The glazing rim 33 comprises four elongated glazing rim members 36 (shown in FIGS. 3 and 7) forming the rectangular glazing rim 33. Each of the glazing rim members 36, as best shown in FIG. 7, includes a leg portion 38 and a lip portion 40 formed integrally with the leg portion 38 and extending outwardly therefrom and having distal end 39.

Figure 7:
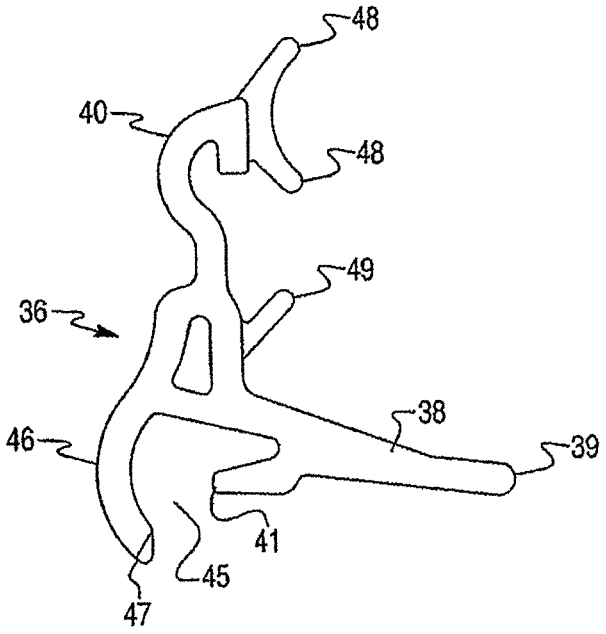
FIG. 7 is a fragmentary cross-sectional view of a glazing rim member according to the preferred embodiment of the present invention.

As shown in FIG. 7, the lip portion 40 of the glazing rim member 36 has a plurality of lip portion flexible sealant fins 48 extending inwardly therefrom to support the glass insert 6 positioned within the opening of the door 2 on the side opposite to the lip portion 28 of the first door skin 10. The lip portion flexible sealant fins 48 provide a contact force against the glass insert 6 so as to prevent rattling of the glass insert 6 within the door 2.

The glazing rim member 36 further includes a skirt portion 46 extending from the lip portion 40 and formed integrally therewith so as to form a pilot cavity 45 between the skirt portion 46 and a pilot edge 41 of the leg portion 38 of the glazing rim member 36. The pilot cavity 45 is provided for receiving the guide rim 15 of the second door skin 20 therein. As best shown in FIG. 7, a distal end 47 of the skirt portion 46 is a skirt portion flexible sealant fin 47 that applies contact pressure to the outer wall 19 of the second door skin 20 when the glazing rim member 36 is assembled therewith. The glazing rim member 36 further includes a midsection flexible sealant fin 49 disposed between the lip portion 40 and the leg portion 38.

The lip portion sealant fins 48, the midsection sealant fin 49, and the skirt portion sealant fin 47 allow the glazing rim member 36 to be interference fitted to the second door skin 20, the glass insert 6, and the glazing rim locking tabs 52. Each of the sealant fins 48, 49, and 47 is flexible so as to apply a contact force to the glass insert 6 and the second door skin 20 when assembled with the first and second door skins 10 and 20 and the glass insert 6. Since each of these sealant fins 47, 48, and 49 is pressed against a corresponding surface of the glass insert 6 or the second door skin 20, the friction that results from the contact pressure maintains the glazing rim member 36 in engagement with the insert 6. Accordingly, a tight seal is provided between an area on the glass insert 6 where the lip portion sealant fins 48 contact the glass insert 6 and the guide wall 19 of the second door skin 20.

Additionally, the sealant fins 48, 49, and 47 provide resistance to movement of the glass insert 6 within the opening in the door 2. As a result, the door 2 assembled from the first and second door skins 10 and 20, the glass insert 6, and the glazing rim member 36 is maintained in a stable state without shifting or movement of the components.

According to the preferred embodiment of the present invention, the glazing rim member 36 is coextruded from appropriate polymer materials as a single-piece part, which may then be cut to length and mitred to provide the individual glazing rim frame members 36 with the sealant fins 47, 48, and 49 formed from a flexible polyvinyl chloride and the remaining portions formed from a rigid polyvinyl chloride.

The lip portion 40, the skirt portion 46, and the leg portion 38 of the glazing rim member 36 may be made of a rigid extrusion material and the flexible sealant fins 47, 48, and 49 may be made of a flexible extrusion material.

For example, the glazing rim member 36 may be made of polyvinyl chloride (PVC). More specifically, the glazing rim member 36 may be coextruded from PVC such that the lip portion 40, the skirt portion 46, and the leg portion 38 of the glazing rim member 36 are made of a rigid PVC while the sealant fins 47, 48, and 49 are made of a flexible PVC (e.g., PVC 74±4 Shore A Durometer).

In an assembled position, illustrated in FIG. 3, the leg portion 38 of the glazing rim member 36 is placed in contact with the outer peripheral surface 18 of the flange portion 24 of the second door skin 10 so that a distal end 39 of the leg portion 38 is located in a second notch 23 formed by the outer peripheral surface 18 of the flange portion 24, the distal end 27 of the flange portion 14, and the glazing rim locking tab 52. The glazing rim member 36 is properly oriented relative to the second door skin 20 by the guide rim 15 of the second door skin 20. More specifically, through the application of suitable force, the guide rim 15 is received in the pilot cavity 45 so that the pilot edge 41 of the glazing rim member 36 engages the inner wall 17 of the guide rim 15.

Furthermore, in the assembled position, due to the resilient nature of the material forming the flexible sealant fin 47 of the skirt portion 46, the glazing rim member 36 tightly engages the outer wall 19 of the guide rim 15 of the second door skin 20. Due to the intimate contact between the flexible sealant fin 47 and wall 19, the skirt portion 46 functions as a window seal element. Also, because the material used to form the sealant fins 47, 48, and 49 of the glazing rim member 36 is resilient, the glazing rim member 36 may readily be removed in the event the glass insert 6 should become broken. Thus the glass insert 6 may be replaced without the necessity of replacing the door 2. Furthermore, because the glazing rim member 36 is formed of a resilient material, it forms a tight seal with the glass insert 6. Preferably, door skin 20 is the interior door skin and door skin 10 is the exterior or outside door skin.

As further illustrated in FIG. 3, the glazing rim member 36 is locked in position by snap-locking the distal end 39 of the leg portion 38 thereof in the second notch 23 formed between the outer peripheral surface 18 of the flange portion 24 of the second door skin 20, the glazing rim locking tab 52, and the distal end 27 of the flange portion 14 of the first door skin 10.

The glass insert positioning tab 53 is disposed along the flange portion 14 of the first door skin 10 above the glazing rim locking tab 52. The glass insert positioning tab 53 maintains the glass insert in a predetermined position with respect to the opening in the door 2.

Figure 6A:
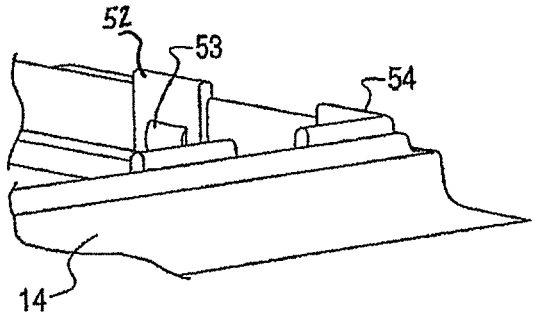
FIGS. 6A through 6C are fragmentary perspective views of positioning tabs on the first door skin depicted around arrows X, Y, and W of FIG. 2A according to the preferred embodiment of the present invention.
Figure 6B:
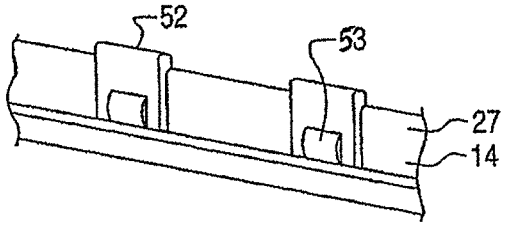
Figure 6C:
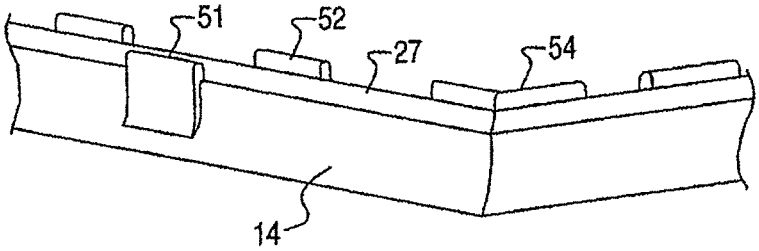

As best shown in FIGS. 6A to 6C, the flange portion 14 includes the skin positioning tabs 51, the glass insert positioning tabs 53, and the glazing rim locking tabs 52 spaced apart from each other in predetermined intervals (i.e., in a discontinuous manner). Furthermore, a corner glazing rim locking tab 54 may be disposed at a corner of the flange portion 14 to lock the glazing rim member 36 in the corners of the opening 11. The corner glass insert positioning tab 54 and the glass insert positioning tab 53 prevent the glass insert 6 from shifting in the opening in the door 2.

The glass insert 6 may be a preassembled two-pane unit or cassette that can be installed readily in the opening during assembly of the door 2. Additionally, due to the strength of assembly of the door 2, laminate glass may be used as the glass insert 6 and the possibility of glass breakage is minimized. The glass insert 6 may be impact resistant.

The procedure of assembling the door 2 with the glass insert 6 according to the preferred embodiment of the present invention will now be described.

First, the first and second door skins 10 and 20 are formed preferably by a compression molding process from any appropriate polymer material, such as fiber glass reinforced SMC. The openings 11, 21 are preferably molded into the door skins 10, 20 in order to reduce material cost and minimize manufacturing costs.

Then, the first and second door skins 10 and 20, the top and bottom rails 7, and the left and right stiles 8 are aligned and attached to each other with adhesive. In this position, the first notch 26 of the flange portion 14 of the first door skin 10 engages the distal end 16 of the flange portion 24 of the second door skin 20 to form a joint and define the cavity 34 (as shown in FIG. 3) between the first and second door skins 10 and 20, respectively. The distal end 16 of the flange portion 24 is maintained in the first notch 26 by the second skin positioning tab 51 and the distal end 27 of the flange portion 14.

Next, the cavity 34 between the first and second door skins 10 and 20 is tilled with the expandable foam material 35 which expands within the cavity 34 and may force together the flanges 14 and 24 of the first and second door skins 10 and 20, respectively. The expandable foam may be a polyurethane foam or other foamable material that adds weight to the door 2 and also provides sound and thermal insulation properties.

Preferably, the step of filling the cavity 34 with the foam material 35 is performed while the semi-assembled door 2 is held in an appropriate press (not shown). The semi-assembled door 2 is placed into the press to hold the skins 10, 20 into engagement with the stiles and rails. The press platens may be heated to enhance curing of the adhesive bonding the stiles and rails to the door skins. The press platens have sufficient strength to prevent deflection of the planar plate portions 12, 22 of the door skins 10, 20 during the foaming operation.

The door 2 is then removed from the press. Thereafter, a sealant 100 may be applied to the lip portion 28 of the first door skin 10 in groove 102, as best shown in FIG. 3. The sealant 100 may be a silicone material, caulk, or other material that seals the insert 6 to prevent water from leaking beyond flange 104 and 106 into the interior of the door 2. The glass insert 6 is then inserted through the opening 21 in the second door skin 20 until the glass insert 6 engages the lip portion 28 of the first door skin 10.

Subsequently, the glazing rim member 36 is mounted to the flange portion 24 of the second door skin 20 so that the leg portion 38 of the glazing rim member 36 is angled downward and moved in contact with the outer peripheral surface 18 of the flange portion 24 of the second door skin 20. As noted above, the glazing rim member 36 is properly oriented relative to the first door skin 10 by the guide rim 15 of the second door skin 20 engaging the pilot edge 41 and the skirt portion flexible sealant fin 47 of the glazing rim member 36.

As the glazing rim member 36 is forced into position, the flexible sealant fins 47, 48 and 49 apply a flexible resistance until the pilot edge 41 is moved passed the inner wall 17 of the guide rim 15. At this time, the pilot edge 41 is pushed down along the inner wall 17 such that the guide rim 15 is disposed within the pilot cavity 45. In this position, the glazing rim member 36 is interference fitted to the second door skin 20 and the glass insert 6. Accordingly, the force provided by the flexible sealant fins 47, 48, and 49 push the surface 41 of the glazing rim member 36 into the wall 17 to prevent the glazing rim member 33 from coming out of engagement and prevents the glazing rim member 36 from moving. Also in this position, the flexible sealant fins 47, 48, and 49 may be slightly deformed due to the interference fitting.

Additionally, the glazing rim member 36 is snap-locked into position such that the distal end 39 of the leg portion 38 is secured in the second notch 23 formed between the outer peripheral surface 18 of the flange portion 24, the distal end 27 of the flange portion 14, and the glazing rim member locking tab 52. Also in this position, the lip portion 40 of the glazing rim member 36 is placed against the glass insert 6 laid in the opening of the door 2 on the side opposite to the lip portion 28 of the first door skin 10. This procedure is repeated for each of the glazing rim frame members 36. Thus, the glass insert 6 is locked in place.

We prefer that the door 2 be removed from the press and stored in inventory, so that the appropriate glazing unit 6 may be installed as ordered by consumers.

While we prefer that the flange portion 14 provide a dam, it should be recognized that the expansion of foam 35 could be sufficient to force flange portion 24 upwardly into secure contact of flange portion 14 to further enhance the seal provided by the flange portions. In other words, the flange 24 may be deflected by the expansion force of foam 35.

Also, while we prefer that the core be foam 35, the core could be a wood composite, wood, wood, wood substrate, or foam cement.

The foregoing description of the preferred embodiment of the present invention has been presented for the purpose of illustration in accordance with the provisions of the patent statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A door, comprising:

a first door skin having a first planar portion formed with a first opening for receiving a glass insert, said first opening being defined by a first flange extending inward from said first planar portion and a lip portion extending from where said first flange meets said first planar portion and substantially parallel to said first planar portion to contact a first major surface of said glass insert;

a second door skin opposite to said first door skin to form a cavity therebetween and having a second planar portion formed with a second opening for receiving said glass insert, said second opening defined by a second flange extending into said cavity from said second planar portion to engage said first flange;

a glazing rim member having a leg portion disposed on a surface of said second flange with and a lip portion extending substantially parallel to said second planar portion of said second door skin and having at least one flexible sealant fin extending from the lip portion to apply a contact pressure to a second major surface of said glass insert; and a core material disposed in the cavity between said first and second door skins, wherein the core material is in contact with the first and second flanges and deflects the second flange to force the first and second flanges together.

2. The door according to claim 1, wherein said second flange extends more than half the width of the cavity.

3. The door according to claim 1, wherein said at least one flexible sealant fin of the glazing rim member is deformed by pressure exerted on the glass insert.

4. The door according to claim 1, wherein:

said second flange includes a guide rim extending outward from the surface of the second flange; and said glazing rim member includes a pilot cavity extending into a surface of said leg portion, said pilot cavity securing said guide rim of the second flange therein.

5. The door according to claim 1, wherein:

said first door skin includes a glazing rim locking tab extending from the lip portion above said first flange; and said first flange has a distal end with a first notch that engages a distal end of said second flange and a second notch formed between the second flange, the distal end of the first flange, and said glazing rim locking tab in which said leg portion of the glazing rim member is secured.

6. The door according to claim 1, wherein said core is one of a foam material, wood composite, wood, or foam cement.

7. The door according to claim 1, wherein said at least one flexible sealant fin includes a plurality of flexible sealant fins extending from a top of the lip portion to contact a first region of the second major surface of the glass insert and at least one flexible sealant fin extending from a middle of the lip portion to contact a second region of the second major surface of the glass insert.

8. The door according to claim 1, wherein:

said second door skin has an outer wall formed where said second flange meets said second planar portion, said outer wall being angled with respect to said second planar portion and said second flange; and said glazing rim member has a flexible sealant fin angled with respect to said leg portion and said lip portion thereof, said flexible sealant fin engaging said outer wall of the second door skin.

9. The door according to claim 1, wherein said lip portion and said leg portion of said glazing rim member are formed of a rigid extrusion material, and said at least one flexible sealant fin is formed of a flexible extrusion material.

10. The door according to claim 9, wherein said second door skin includes a guide rim extending from a region where said second flange meets said second planar portion, and said glazing rim member includes a skirt portion extending from a region where the leg portion meets the lip portion, said skirt portion defining a cavity to engage said guide rim on the second flange.

11. The door according to claim 9, wherein said rigid extrusion material comprises rigid PVC and said flexible extrusion material comprises flexible PVC.

12. The door according to claim 9, wherein said lip portion of said glazing rim member, said leg portion of said glazing rim member, and said at least one flexible sealant fin are coextruded from a predetermined polymer material.

13. The door according to claim 1, wherein said first flange extends normally from said first planar portion, and said second flange extends normally from said second planar portion.

14. A door, comprising:

first and second door skins operatively secured to form a cavity therebetween filled with a foam material;

each of said first and second door skins has a substantially planar plate portion formed with an opening therethrough for receiving a glass insert, each opening defined by a flange portion formed integrally with said planar plate portion and extending substantially inwardly therefrom toward the opposite door skin;

said second door skin has a lip portion formed integrally with said planar plate portion of said second door skin and extending from said flange portion substantially along said planar plate portion;

said flange portion of said second door skin has a thickness allowing substantially no deflection thereof due to expansion pressure of the foam material within said cavity;

said flange portion of said first door skin has a thickness allowing some deflection thereof due to the expansion pressure of the foam material within said cavity, wherein the foam material is in contact with the flange portion of the first door skin and deflects the flange portion of the first door skin to force the flange portion of the second door skin and flange portion of said first door skin together;

distal ends of said flange portions of said first and second door skins engaging each other in an overlapping relationship to form an interlocking lap joint and define said cavity between said first and second door skins;

and a glazing rim member including a lip portion disposed opposite said lip portion of said second door skin and a leg portion supported by said flange portion of said first door skin.

15. The door according to claim 14, wherein a distal end of said leg portion of said glazing rim member is snap-locked between said flange portion of said second door skin and said distal end of said flange portion of said first door skin.

16. The door according to claim 14, wherein said lip portion of said glazing rim member is formed of a resilient material.

17. The door according to claim 14, wherein said interlocking lap joint is disposed intermediate between said planar plate portions of said first and second door skins.

18. The door according to claim 14, wherein the thickness of said second door skin flange portion exceeding the thickness of said first door skin flange portion.

19. The door according to claim 14, wherein said first door skin has an upwardly extending guide rim lockingly engaged with a pilot edge of said glazing rim member.

20. A building component, comprising:

a first building component skin having a first planar portion formed with a first opening for receiving a glass insert, said first opening being defined by a first flange extending inward from said first planar portion and a lip portion extending from where said first flange meets said first planar portion and substantially parallel to said first planar portion to contact a first major surface of said glass insert;

a second building component skin opposite to said first building component skin to form a cavity therebetween and having a second planar portion formed with a second opening for receiving said glass insert, said second opening defined by a second flange extending into said cavity from said second planar portion to engage said first flange;

a glazing rim member having a leg portion disposed on a surface of said second flange with and a lip portion extending substantially parallel to said second planar portion of said second building component skin and having at least one flexible sealant fin extending from the lip portion to apply a contact pressure to a second major surface of said glass insert; and a core material disposed in the cavity between said first and second building component skins, wherein the core material is in contact with the first and second flanges and deflects the second flange to force the first and second flanges together.

* * * * *